US012312130B2

(12) United States Patent
Cahalan et al.

(10) Patent No.: US 12,312,130 B2
(45) Date of Patent: May 27, 2025

(54) LID FOR CONTAINER

(71) Applicant: Professional Disposables International, Inc., Orangeburg, NY (US)

(72) Inventors: Gerard Cahalan, New Milford, CT (US); Josephine Allakpo, Bronx, NY (US); Ravi Katara, Sparta, NJ (US)

(73) Assignee: Professional Disposables International Inc., Orangeburg, NY (US)

( * ) Notice: Subject to any disclaimer, the term of this patent is extended or adjusted under 35 U.S.C. 154(b) by 0 days.

(21) Appl. No.: 17/720,444

(22) Filed: Apr. 14, 2022

(65) Prior Publication Data

US 2022/0332474 A1 Oct. 20, 2022

Related U.S. Application Data

(60) Provisional application No. 63/175,344, filed on Apr. 15, 2021.

(51) Int. Cl.
*B65D 43/16* (2006.01)
*B65D 83/08* (2006.01)

(52) U.S. Cl.
CPC ..... *B65D 43/16* (2013.01); *B65D 83/08* (2013.01)

(58) Field of Classification Search
CPC ..... A47K 2010/3266; A47K 10/3818; A47K 10/421; A47K 10/42; A47K 10/423
USPC ..... 221/63, 306, 303, 33; 206/494, 210, 812
See application file for complete search history.

(56) References Cited

U.S. PATENT DOCUMENTS

| | | | | |
|---|---|---|---|---|
| 3,868,052 | A | 2/1975 | Rockefeller | |
| 4,262,816 | A | 4/1981 | Margulies | |
| 4,289,262 | A | 9/1981 | Finkelstein | |
| 4,462,507 | A | 7/1984 | Margulies | |
| 4,534,491 | A * | 8/1985 | Norton | A47K 10/3818 221/63 |
| D296,765 | S | 7/1988 | Urion | |
| 4,854,473 | A * | 8/1989 | Dubach | B65D 47/0814 220/838 |
| D354,224 | S | 1/1995 | Norton et al. | |
| D354,225 | S | 1/1995 | Norton et al. | |

(Continued)

FOREIGN PATENT DOCUMENTS

| | | |
|---|---|---|
| DE | 10 2006 001 322 A1 | 7/2007 |
| EP | 3 175 754 A1 | 6/2017 |

(Continued)

OTHER PUBLICATIONS

Extended European Search Report for Application No. 22168301.4 mailed Sep. 7, 2022.

*Primary Examiner* — Steven A. Reynolds
*Assistant Examiner* — Prince Pal
(74) *Attorney, Agent, or Firm* — Melissa M. Hayworth; E. Joseph Gess; Merchant & Gould, P.C.

(57) ABSTRACT

A lid for a container includes a base with a sidewall having a first end and an opposite second end defining a longitudinal axis. A cover disposed at the second end and defining an opening, and a bead extends inwardly from the sidewall relative to the longitudinal axis and proximate the first end. The bead has an extension distance and a portion of the bead has a reduced extension distance. The lid also includes a cap configured to couple to the base and selectively engage the cover proximate the opening.

29 Claims, 8 Drawing Sheets

(56) References Cited

U.S. PATENT DOCUMENTS 5,437,383 A * 8/1995 Stull ..... B65D 47/0814 220/834
5,467,893 A 11/1995 Andis et al.
5,516,001 A 5/1996 Muckenfuhs et al.
5,540,343 A * 7/1996 Schumacher ..... B65D 47/0814 220/838
5,560,514 A 10/1996 Frazier
5,718,353 A * 2/1998 Kanfer ..... A47K 10/3818 215/331
5,908,138 A * 6/1999 Vlahakis ..... B65D 83/0805 206/409
5,938,013 A 8/1999 Palumbo et al.
D418,059 S 12/1999 Hill
6,065,626 A * 5/2000 Huang ..... B65D 43/0212 220/795
6,152,322 A 11/2000 Marino
6,182,858 B1 * 2/2001 Hartog ..... A47K 10/3818 221/63
6,206,221 B1 * 3/2001 Bando ..... B65D 47/0871 220/829
6,321,923 B1 11/2001 Wood
6,331,696 B1 * 12/2001 Nakamura ..... A47K 10/422 219/521
6,364,101 B1 * 4/2002 Schultz ..... A47K 10/3818 220/375
6,409,044 B1 6/2002 Brown et al.
6,499,626 B1 * 12/2002 Julius ..... B65D 83/0805 221/303
6,554,156 B1 * 4/2003 Chong ..... A47K 10/3818 221/303
D479,996 S 9/2003 Geib
6,729,498 B2 * 5/2004 Yelton ..... B65D 43/169 221/63
6,786,447 B2 9/2004 Geib et al.
D498,623 S 11/2004 Sams et al.
6,889,867 B1 * 5/2005 Smith ..... B65D 47/0838
D531,499 S 11/2006 Zaidman
7,163,124 B2 * 1/2007 Bushman ..... A47K 10/3818 221/33
7,172,093 B2 * 2/2007 Bando ..... B65D 83/0805 221/63
7,204,389 B2 * 4/2007 Smith ..... B65D 43/0212
D542,652 S 5/2007 Moribata et al.
D544,346 S 6/2007 Karussi et al.
7,303,092 B2 12/2007 Sarbo et al.
7,354,598 B2 * 4/2008 Masting ..... A47K 10/3836 424/443
7,422,126 B2 9/2008 Ceschi
7,510,095 B2 * 3/2009 Comeau ..... B65D 47/0871 220/837
D596,028 S 7/2009 Bartolucci et al.
7,556,175 B2 * 7/2009 Simkins ..... A47K 10/3818 221/45
7,628,292 B2 * 12/2009 Lancesseur ..... B65D 51/04 221/309
7,648,046 B2 * 1/2010 Sosalla ..... F28D 20/023 221/36
7,731,057 B2 * 6/2010 Evans ..... A47K 10/3818 221/36
D624,414 S 9/2010 Benoit-Gonin et al.
7,806,292 B2 * 10/2010 Simkins ..... A47K 10/3818 221/39
7,854,346 B2 * 12/2010 Bendor ..... A47K 10/421 221/36
7,997,444 B2 8/2011 Martins
8,245,865 B2 * 8/2012 Damaghi ..... B65D 83/0805 220/264
8,262,832 B2 9/2012 Hebert et al.
D671,426 S 11/2012 Pickens et al.
8,317,061 B2 * 11/2012 Vignot ..... A47K 10/42 221/45
8,474,651 B2 7/2013 Simkins
D703,534 S 4/2014 Yamada
D703,535 S 4/2014 Yamada
D704,057 S 5/2014 Bar-Tal et al.
8,777,030 B2 7/2014 Ziegenhorn et al.
8,794,460 B2 * 8/2014 Druitt ..... B65D 50/061 220/345.2
8,931,663 B1 1/2015 Evans et al.
9,073,673 B2 * 7/2015 Mazurkiewicz ..... B65D 51/249
9,095,243 B2 8/2015 Ray et al.
D741,181 S 10/2015 Bar-Tal et al.
9,309,041 B2 4/2016 Mabee et al.
9,399,540 B2 7/2016 Bushman et al.
D763,074 S 8/2016 Neitzel
D771,489 S 11/2016 Azelton et al.
9,498,091 B2 11/2016 Yamada
D773,930 S * 12/2016 Azelton ..... D9/447
9,643,766 B1 5/2017 Huffer
9,725,208 B2 * 8/2017 Dols ..... B65D 21/0223
9,974,419 B2 5/2018 Azelton et al.
9,975,290 B2 5/2018 Davis et al.
D819,456 S * 6/2018 Gómez Martín ..... D9/503
9,986,875 B2 * 6/2018 Mehdizadeh ..... B65D 47/0871
10,039,425 B2 8/2018 Azelton et al.
D836,433 S * 12/2018 Cahalan ..... D9/447
D837,661 S 1/2019 Hugley
10,231,582 B2 3/2019 Mehdizadeh
10,327,602 B2 * 6/2019 Azelton ..... B65D 83/0811
10,472,141 B2 * 11/2019 Wang ..... B65D 51/22
10,518,942 B2 12/2019 Seibert et al.
10,526,127 B2 1/2020 Leung et al.
10,676,271 B2 6/2020 Frank
10,722,082 B2 * 7/2020 Dansreau ..... A47K 10/3818
10,791,887 B2 * 10/2020 Simmons ..... B65D 83/0894
D902,715 S 11/2020 Yu
10,843,849 B1 * 11/2020 Berge ..... B65D 47/0857
D908,490 S 1/2021 Trombley et al.
10,894,656 B2 1/2021 Lange et al.
2001/0020632 A1 9/2001 De Oliveira et al.
2002/0060222 A1 * 5/2002 Bando ..... A47K 10/421 221/48
2002/0179627 A1 * 12/2002 Huang ..... B65D 83/0805 221/63
2003/0080018 A1 * 5/2003 Nally ..... A47K 10/3818 206/494
2005/0046314 A1 * 3/2005 Sellars ..... B65D 83/0805 312/34.4
2005/0061826 A1 * 3/2005 Long ..... B65D 83/0811 221/33
2005/0067313 A1 * 3/2005 Banik ..... B65D 83/0805 206/812
2005/0087543 A1 * 4/2005 Smith ..... B65D 43/0212 221/63
2005/0092764 A1 * 5/2005 Chasid ..... B65D 83/0805 221/63
2005/0205594 A1 * 9/2005 Evans ..... A47K 10/3818 221/63
2005/0230408 A1 * 10/2005 Seager ..... A47K 10/421 221/45
2005/0279757 A1 * 12/2005 Bitowft ..... A47K 10/426 221/45
2006/0180596 A1 * 8/2006 Young ..... A47K 10/423 221/63
2007/0125793 A1 * 6/2007 Wendle ..... A47K 10/421 221/45
2007/0215631 A1 * 9/2007 Bendor ..... A47K 10/421 221/63
2007/0215632 A1 * 9/2007 Bendor ..... A47K 10/426 221/63
2008/0110920 A1 5/2008 Hlista et al.
2008/0277369 A1 11/2008 Robinson
2009/0114669 A1 * 5/2009 Decker ..... A47K 10/3818 221/46
2009/0152290 A1 * 6/2009 Wang ..... B65D 47/06 221/63
2009/0255950 A1 * 10/2009 Simkins ..... A47K 10/3818 220/254.1
2009/0289077 A1 11/2009 Melin et al.

(56) References Cited

U.S. PATENT DOCUMENTS

2009/0289078 A1* 11/2009 Melin ..... A47K 10/421 221/45
2009/0308777 A1* 12/2009 Banik ..... B65D 83/0805 206/494
2010/0072218 A1 3/2010 Meyer et al.
2010/0078443 A1* 4/2010 Hoefing ..... A47K 10/3818 221/45
2010/0108706 A1* 5/2010 Oman ..... A47K 10/3818 221/45
2010/0133287 A1 6/2010 Tramontina et al.
2010/0206896 A1* 8/2010 Ray ..... A47K 10/3818 221/45
2010/0224643 A1 9/2010 Daggett
2010/0294792 A1* 11/2010 Vignot ..... A47K 10/42 221/45
2012/0145737 A1* 6/2012 Ray ..... B65D 83/0805 221/45
2013/0081970 A1* 4/2013 Dietvorst ..... B65D 25/282 206/494
2014/0021219 A1* 1/2014 Honan ..... B65D 83/08 221/306
2014/0144803 A1* 5/2014 Yamada ..... B65D 83/0811 206/494
2014/0190983 A1* 7/2014 Sanguinet ..... A47K 10/3818 221/63
2014/0291343 A1* 10/2014 Neitzel ..... A47K 10/3818 221/63
2014/0367400 A1* 12/2014 Crudge ..... A47K 10/38 221/63
2015/0114867 A1* 4/2015 Mehdizadeh ..... A47K 10/421 206/494
2015/0114868 A1* 4/2015 Mehdizadeh ..... A47K 10/421 206/494
2015/0114985 A1* 4/2015 Mehdizadeh ..... B65D 83/0805 221/63
2015/0282681 A1* 10/2015 Pierson ..... B65D 75/5827 220/254.1
2015/0305579 A1* 10/2015 Azelton ..... B65D 85/62 221/63
2015/0329251 A1* 11/2015 Sanguinet ..... B65D 25/22 220/254.3
2016/0000278 A1* 1/2016 Yamada ..... B65D 83/08 221/58
2016/0022098 A1* 1/2016 Yamada ..... B65D 83/0817 221/63
2016/0106273 A1* 4/2016 Yamada ..... B65D 75/5877 221/63
2016/0113450 A1* 4/2016 Yamada ..... B65D 75/5894 221/53
2017/0036835 A1 2/2017 Duncan
2017/0042395 A1* 2/2017 Azelton ..... A47K 10/421
2017/0129660 A1* 5/2017 Hsu ..... B65D 51/18
2017/0245699 A1* 8/2017 Keily ..... A47K 10/38
2017/0258279 A1* 9/2017 Wahl ..... B65D 85/62
2017/0354299 A1* 12/2017 Schöler ..... A47K 10/38
2018/0317720 A1* 11/2018 Azelton ..... B65D 83/0811
2019/0069732 A1* 3/2019 Miura ..... A47K 10/32
2020/0085247 A1* 3/2020 Lutkins ..... B65D 83/08
2020/0405102 A1 12/2020 Azelton et al.
2022/0135284 A1* 5/2022 Miura ..... B65D 43/162 206/494
2022/0233032 A1* 7/2022 Miura ..... B65D 43/168
2022/0332474 A1* 10/2022 Cahalan ..... B65D 43/16

FOREIGN PATENT DOCUMENTS

EP 3 611 112 A1 2/2020
EP 3 636 124 A2 4/2020
JP 2019-142555 A 8/2019
KR 10-2017-0028552 A 3/2017
WO 2008/110770 A1 9/2008
WO 2014/73334 A1 5/2014
WO 2015/069257 A1 5/2015
WO 2020/239643 A1 12/2020

* cited by examiner

LID FOR CONTAINER

CROSS-REFERENCE TO RELATED APPLICATIONS

This application claims priority to and the benefit of U.S. Provisional Patent Application No. 63/175,344, filed Apr. 15, 2021, which is incorporated by reference herein in its entirety.

BACKGROUND

The present disclosure relates generally to lids for containers that dispense a sheet material, for example, rolled wet or dry wipes.

At least some known sheet materials are stored in a dispenser apparatus that includes a lid and a container. The lid is removably coupled to the container so that the lid can be removed for starting the sheet material and then reattached. The lid can have a base that couples to the container and that defines an opening for extracting the sheet material. A cap is attached to the base and is used for closing the opening on the dispenser apparatus. Some users grasp and pull on the cap to remove the lid from the container, thereby, inducing large forces on the connection between the cap and the base, possibly damaging or completely severing these connection components. Additionally, it can be difficult for users to move the cap between open and closed configurations. The cap may not fully open or close, impair access to the dispensing opening, and/or the cap may not align with the dispensing opening for closure. Improvements to lid assemblies are thereby desired.

SUMMARY

In one aspect, the technology relates to a lid for a container, the lid including: a base including: a sidewall having a first end and an opposite second end defining a longitudinal axis; a cover disposed at the second end and defining an opening; and a bead extending inwardly from the sidewall relative to the longitudinal axis and proximate the first end, the bead having an extension distance, wherein a portion of the bead has a reduced extension distance; and a cap configured to couple to the base and selectively engage the cover proximate the opening.

In an example, a hinge couples the cap to the base, and the portion of the bead that has the reduced extension distance is proximate the hinge. In another example, the portion of the bead that has the reduced extension distance has a first end, an opposite second end, and a midpoint therebetween, and the extension distance of the bead tapers continuously inward relative to the sidewall from the first end and the second end of the portion of the bead that has the reduced extension distance towards the midpoint. In yet another example, a smallest extension distance of the reduced extension distance of the bead occurs at the midpoint. In still another example, a strap is disposed between the cap and the base, the strap defining a width, and the first end of the portion of the bead that has the reduced extension distance is disposed proximate one side of the strap and the second end of the portion of the bead that has the reduced extension distance is disposed proximate the other side of the strap such that the portion of the bead that has the reduced extension distance extends at least across the width of the strap. In an example, the bead has a trapezoidal cross-sectional shape and a thickness of the bead from a radially innermost surface towards the sidewall defines the extension distance.

In another example, the radially innermost surface has a first longitudinal length at the extension distance and a second longitudinal length at the portion of the bead that has the reduced extension distance, the second longitudinal length greater than the first longitudinal length. In yet another example, the bead is offset from the first end, and a thickness of the sidewall at the first end and on one side of the bead is greater than a thickness of the sidewall on an opposite side of the bead proximate the second end. In still another example, a portion of the portion of the bead that has the reduced thickness is planar with an inner surface of the first end of the sidewall.

In another aspect, the technology relates to a lid for a container, the lid includes: a base including: a cylindrical sidewall having a first end and an opposite second end defining a longitudinal axis, the cylindrical sidewall also having an inner surface; a cover disposed at the second end and defining an opening; and a bead extending radially from the inner surface of the cylindrical sidewall and configured to engage with the container, the bead including a first circumferential section and a second circumferential section, the first circumferential section having a radial thickness greater than a radial thickness of the second circumferential section; and a cap connected to the base via a hinge and configured to selectively engage the cover proximate the opening, wherein the second circumferential section of the radial bead is disposed proximate the hinge.

In an example, the second circumferential section has an angular distance of about 90°. In another example, the hinge defines a midpoint of the second circumferential section, and the radial thickness of the second circumferential section tapers inwardly towards the inner surface of the sidewall such that a smallest radial thickness of the second circumferential section is at the midpoint. In yet another example, the bead has a trapezoidal cross-section with a planar surface, and a planar surface of the first circumferential section of the bead has a longitudinal length that is less than a longitudinal length of a planar surface of the second circumferential section of the bead. In still another example, a strap extends between the cap and the hinge, and a width of the strap is approximately equal to a width of the hinge. In an example, the hinge includes: a first arm extending from the base and a second arm extending from the strap coupled together at a flexible joint; and a pair of energy bands extending between the base and the strap flanking the first arm and the second arm, the pair of energy bands define the width of the hinge.

In another aspect, the technology relates to a dispenser for sheet material including: a container defining an interior chamber; and a lid removably secured to the container for closing the interior chamber, the lid including: a base including: a cover defining an opening; a sidewall extending from one side of the cover, the sidewall having an outer surface; and a bead disposed on the sidewall and configured to engage with the container, wherein the bead has a thickness defined from the outer surface of the sidewall; a cap configured to selectively engage the cover proximate the opening; a strap extending from the cap; and a hinge connecting the strap and the base, wherein the thickness of the bead proximate the hinge tapers so as to gradually reduce thickness and reach a thinnest point underneath the hinge.

In an example, the sidewall is cylindrical and the tapering of the bead occurs within ±45° relative to the hinge. In another example, the tapering of the bead is symmetrical relative to the hinge. In yet another example, the thinnest point of the bead is planar with an inner surface of the sidewall on one side of the bead and a step is formed at the inner surface of the sidewall on the other side of the bead. In still another example, the container includes an open end having a circumferential groove defined in an outer surface configured to engage with the bead of the lid. In an example, the circumferential groove has a constant depth around a perimeter of the outer surface.

In another aspect, the technology relates to a lid for a container, the lid including: a base including: a sidewall having a first end and an opposite second end defining a longitudinal axis; and a cover disposed at the second end and defining an opening; a cap coupled to the base and configured to selectively engage the cover proximate the opening, the cap having a strap extending therefrom; and a hinge connecting the strap to the base and defining a rotation axis orthogonal to the longitudinal axis, wherein the hinge has a width defined along the rotation axis and a lever arm distance is defined between the rotation axis and a distal end of the cap along a transverse axis orthogonal to both the longitudinal axis and the rotation axis, and wherein a ratio of the width to the lever arm distance is between about 1:3 and 1:5.

In an example, the ratio of the width to the lever arm distance is about 1:4. In another example, the sidewall has an outer surface and a bead is disposed on the sidewall configured to engage with the container, the bead has a thickness defined from the outer surface of the sidewall, and the thickness of the bead proximate the hinge tapers so as to gradually reduce thickness and reach a thinnest point underneath the hinge.

In another aspect, the technology relates to a lid for a container, the lid including: a base including: a cylindrical sidewall having a first end and an opposite second end defining a longitudinal axis, the cylindrical sidewall defining a diameter; and a cover disposed at the second end and defining an opening; a cap coupled to the base and configured to selectively engage the cover proximate the opening, the cap having a strap extending therefrom; and a hinge connecting the strap to the base and defining a rotation axis orthogonal to the longitudinal axis, wherein the hinge has an outside edge length defined along a transverse axis orthogonal to both the longitudinal axis and the rotation axis, and wherein a ratio of the diameter of the cylindrical sidewall to the outside edge length is between about 1:20 and 1:30.

In an example, the ratio of the cylindrical sidewall to the outside edge length is about 1:25. In another example, the cylindrical sidewall has an inner surface and a bead extending radially from the inner surface of the cylindrical sidewall configured to engage with the container, the bead includes a first circumferential section and a second circumferential section, the first circumferential section having a radial thickness greater than a radial thickness of the second circumferential section, and the second circumferential section of the radial bead is disposed proximate the hinge.

In another aspect, the technology relates to a lid for a container, the lid including: a base including: a sidewall having a first end and an opposite second end defining a longitudinal axis; and a cover disposed at the second end and defining an opening; a cap coupled to the base and configured to selectively engage the cover proximate the opening, the cap having a strap extending therefrom and defining an outer diameter; and a hinge connecting the strap to the base and defining a rotation axis orthogonal to the longitudinal axis, wherein the hinge has a width defined along the rotation axis and the outer diameter of the cap is along a transverse axis orthogonal to both the longitudinal axis and the rotation axis, and wherein a ratio of the width to outer diameter is between about 1:1 and 1:3.5.

In an example, the ratio of the width to the outer diameter is about 1:3. In another example, the sidewall has an outer surface and a bead is disposed on the sidewall configured to engage with the container, the bead has a thickness defined from the outer surface of the sidewall, and the thickness of the bead proximate the hinge tapers so as to gradually reduce thickness and reach a thinnest point underneath the hinge.

DETAILED DESCRIPTION

The technologies described herein relate to a lid for a container and for dispensing sheet material. The lid includes a bi-stable hinge that is thin in the areas of flexing so that a cap can have two-position functionality, and move towards and be held in either an open configuration or a closed configuration. The cap is also automatically aligned over the dispensing opening for quick sealing engagement in the closed configuration. Thus, lid performance and functionality is increased for the user. The cap is positioned out of the way during use and substantially closes with one motion, with cap sealing with one press. Additionally or alternatively, a circumferential bead used to attach the lid to the container is reduced in thickness in the area below the hinge so that tension forces induced on the hinge from removal of the lid are reduced and failure or wear on the hinge components is prevented or decreased.

Many components of the lid may be referred to as having generally cylindrical, circular, annular, or conical features. Such features may be referred to, or defined by, a circumference, radius, external surface, internal surface, and/or other terms appropriate for defining such features. It should be noted that such features may alternatively be elliptical, polygonal, and the like. As used herein, the terms "axial" and "longitudinal" refer to directions and orientations, which extend substantially parallel to a centerline of the lid. Moreover, the terms "radial" and "radially" refer to directions and orientations, which extend substantially perpendicular to the centerline of the lid. In addition, as used herein, the terms "circumferential" and "circumferentially" refer to directions and orientations, which extend arcuately about the centerline of the lid.

Figure 1:
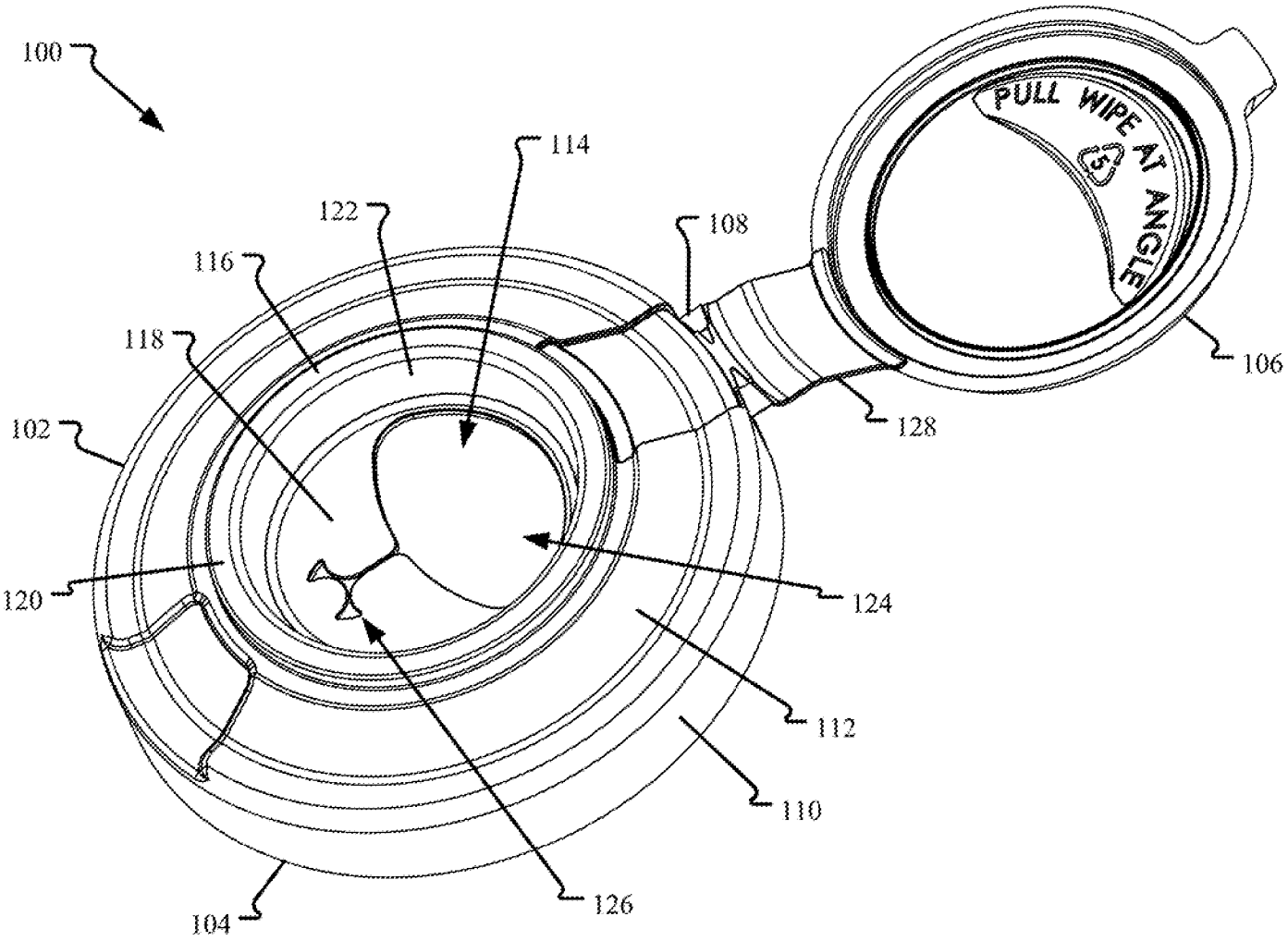
FIG. 1 is a top perspective view of an exemplary lid.

FIG. 1 is a top perspective view of an exemplary lid 100. The lid 100 is configured to removably couple to a container (e.g., the container 300 shown in FIG. 9). In this example, the container is configured to hold a plurality of sheet material (not shown), and the lid 100 enables the dispensing of the sheet material from the container. In an aspect, the sheet material may be a roll of perforated sheet material, and the sheets may be wet or dry and formed from woven or nonwoven materials. The roll of sheet material can be a center pull roll or a perimeter pull roll as required or desired. In other aspects, the sheet material may be a folded stack of sheet material, and the sheet may be wet or dry and formed from woven or nonwoven materials. For wet sheets, the container may be sealed with film so as to prevent the sheets from drying out before access by the user.

The lid 100 is formed from a unitary body 102 that is made from any material which enables the operation of the lid 100 described herein. In an aspect, the body 102 is made from polypropylene or polyethylene and is manufactured as a molded component. The body 102 may be configured to at least partially resiliently deform. The body 102 has a base 104 that couples to the container and a cap 106. The cap 106 is connected to the base 104 via a hinge 108 such that the lid 100 can be opened and closed as described herein. As illustrated in FIG. 1, the lid 100 is in an open configuration (e.g., the cap 106 disengaged from the base 104) that enables the user to dispense the sheet material disposed within the container. The base 104 has a cylindrical sidewall 110 with a cover 112 covering one end. The cover 112 defines an opening 114 that is configured to enable sheet material to be dispensed from the lid 100. The cap 106 is configured to selectively engage with the cover 112 so as to close the opening 114.

The cover 112 has a frustoconical shape so that at least a portion of the cover 112 rises above the sidewall 110. A well 116 is formed on the top of the cover 112 and the well 116 has a bottom wall 118 that the opening 114 is defined in. The bottom wall 118 is recessed relative to a top wall 120 of the well 116 with a well sidewall 122 extending therebetween. The opening 114 has a major orifice 124 in communication with a minor orifice 126. The cap 106 selectively engages with the top wall 120 of the well 116 to close and seal the lid 100 and the orifices 124, 126. Additionally, in this example, a strap 128 connects the cap 106 to the hinge 108 such that the cap 106 is spaced from the hinge 108.

In operation, the lid 100 is coupled to the container with the sheet material inside prior to use. The user may be required to remove the lid 100 from the container to start the sheet material and insert it through the opening 114, and/or remove the film seal from the container. The lid 100 is then reattached to the container and at least a portion of the sheet material extends through the opening 114. Because of the well 116 on the cover 112, the sheet material that is located at the opening 114 can be stored within the well 116 and closed by the cap 106, thereby, increasing access for the user and reducing the drying of sheet material when wet. By having both the major orifice 124 and the minor orifice 126, the major orifice 124 can be used to pull the sheet material through the cover 112 and the minor orifice can be used to assist with separating individual sheets as well as holding sheet material at the well 116. These functions are enabled by moving the sheet material between the major orifice 124 and the minor orifice 126.

Users of the lid 100 are known to pull on the cap 106 to remove the lid 100 from the container. As such, the hinge 108 can be a high wear component and location on the lid 100. In the example described herein, the coupling connection between the base 104 and the container is reduced in the area proximate the hinge 108 so that the tension forces induced in the hinge 108 are reduced when the user is pulling on the cap 106. This configuration reduces wear on the hinge 108, thereby increasing performance of the lid 100. However, the base 104 remains sufficiently coupled to the container so that the lid 100 is reduced or prevented from un-desirably decoupling. Furthermore, by reducing the tension forces acting on the hinge 108, the thickness of the hinge 108 can be reduced, which increases the ability for the hinge 108 to flex and increases the opening and closing functions of the cap 106. For example, increased flexibility of the hinge 108 enables automatic alignment of the cap 106 relative to the well 116 for quick closure with one press. Additionally, the hinge 108 has two-position functionality, with the flexibility of the hinge 108 enabling the cap 106 to be biased towards the open configuration when opened and biased towards the closed configuration when closed. This ensures that the cap 106 is fully out of the way during use and also closes with a single user motion. The configuration of the well 116 also positions the sheet material away from the top wall 120 so that closing performance of the cap 106 is increased when the cap 106 is moving towards the closed configuration.

Figure 2:
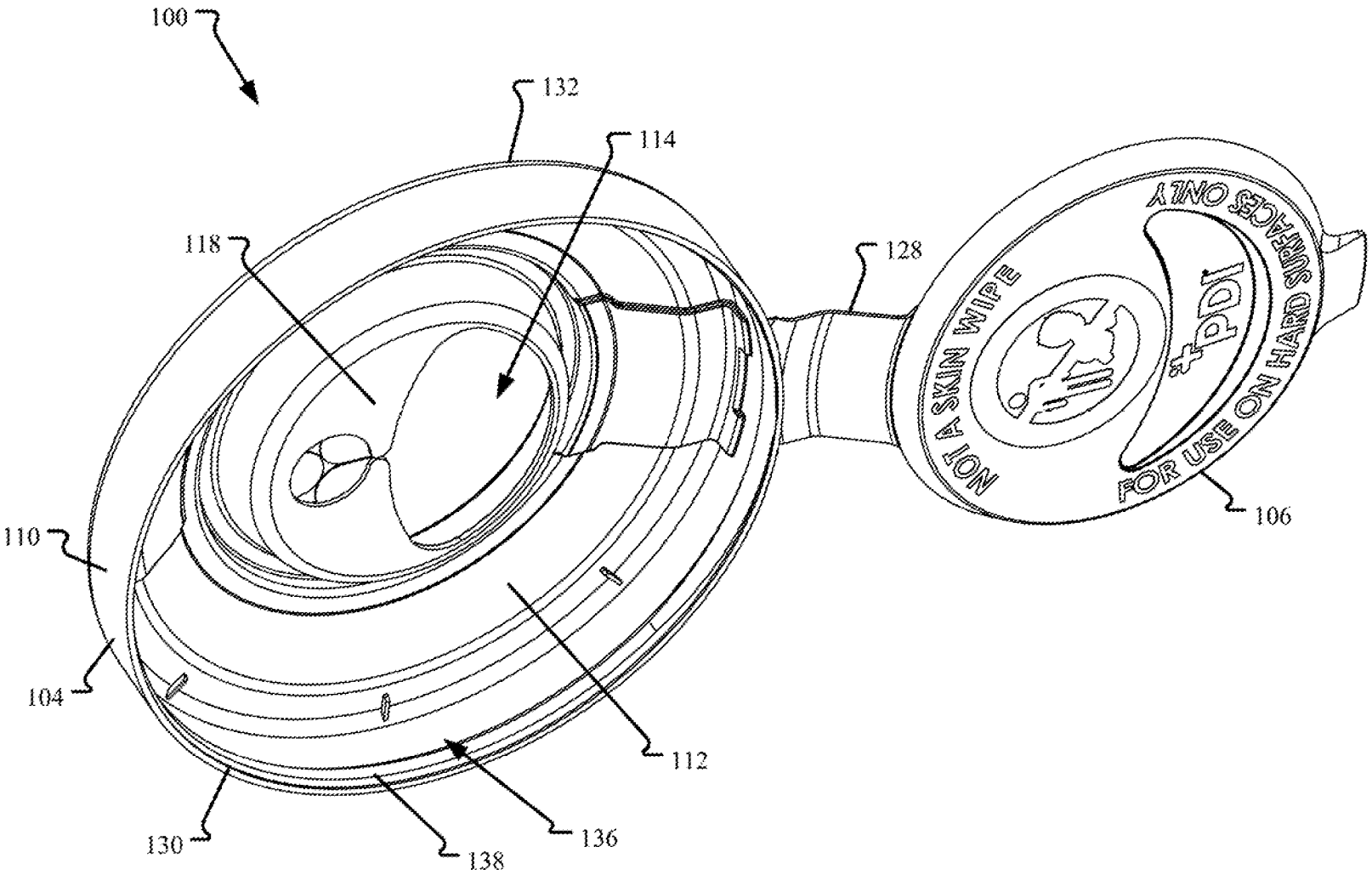
FIG. 2 is a bottom perspective view of the lid shown in FIG. 1.
Figure 3:
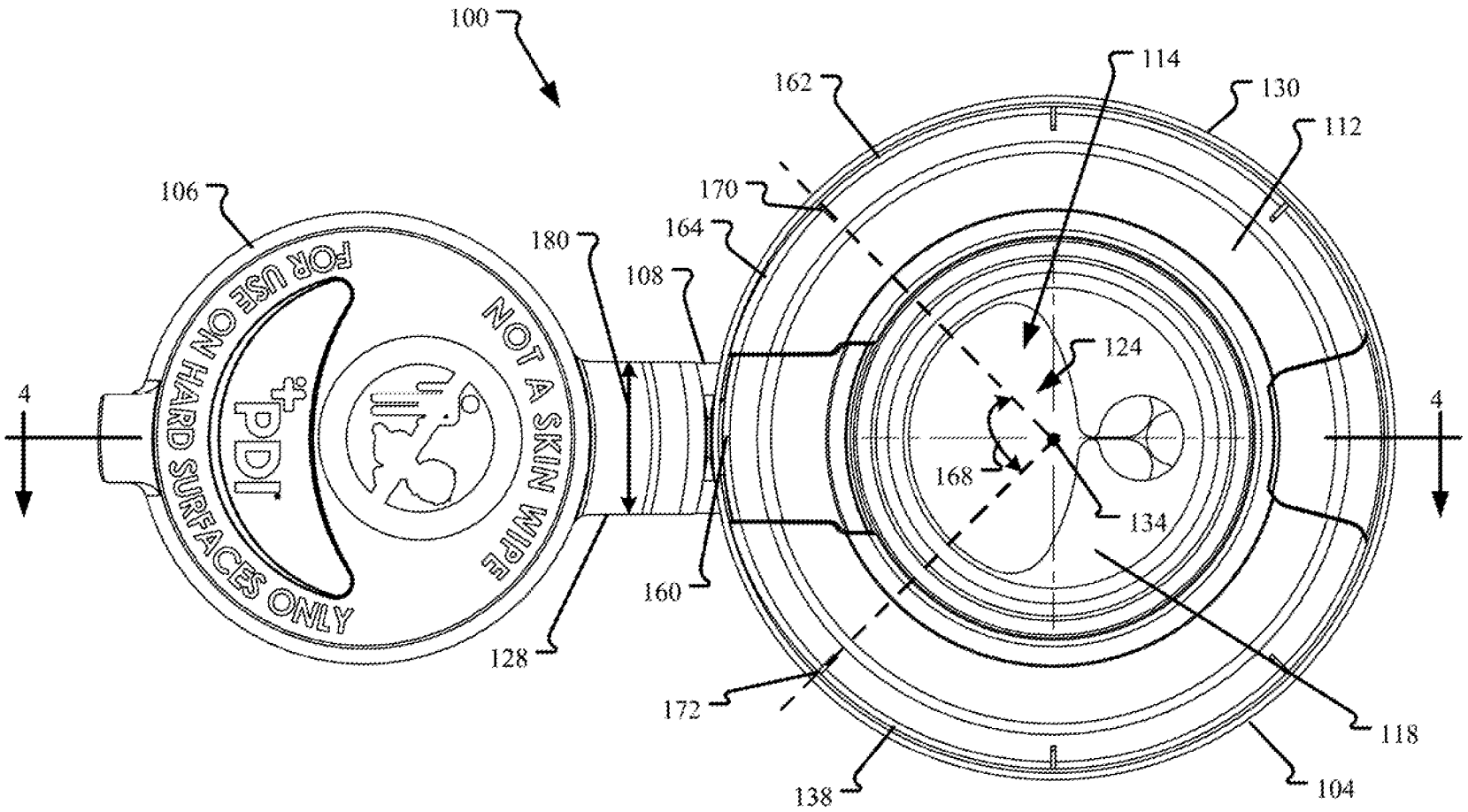
FIG. 3 is bottom plan view of the lid shown in FIG. 1.
Figure 4:
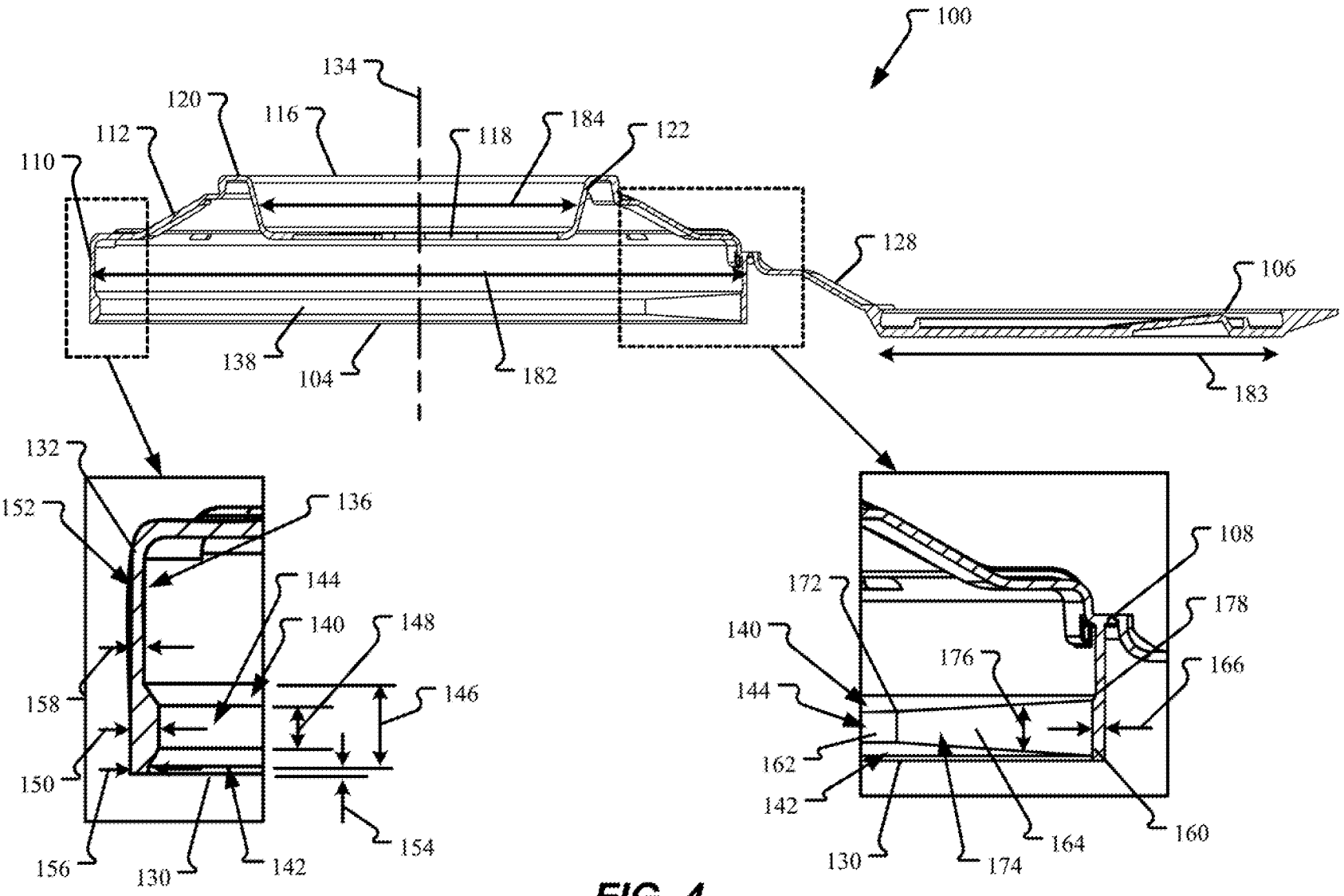
FIG. 4 is a cross-sectional view of the lid taken along line 4-4 in FIG. 3.

FIG. 2 is a bottom perspective view of the lid 100. FIG. 3 is bottom plan view of the lid 100. FIG. 4 is a cross-sectional view of the lid 100 taken along line 4-4 in FIG. 3. Referring concurrently to FIGS. 2-4, the sidewall 110 of the lid 100 has a first end 130 and an opposite second end 132 that define a longitudinal axis 134. The sidewall 110 extends parallel to the longitudinal axis 134 and the cover 112 extends from the second end 132 such that the cover 112 is orthogonal to the longitudinal axis 134. The first end 130 is configured to couple to the container. The sidewall 110 circumferentially extends around the longitudinal axis 134 and has an inner surface 136 that faces the longitudinal axis 134. The inner surface 136 is configured to engage with the container so as to secure the lid 100 to the container. More specifically, a radially inwardly extending bead 138 extends from the inner surface 136 of the sidewall 110 proximate the first end 130. The bead 138 is shaped and sized to engage with a corresponding groove on the container.

In the example, the bead 138 has a trapezoidal cross-sectional shape with two opposing oblique surfaces 140, 142 and a planar surface 144 between. The planar surface 144 can be parallel to both the longitudinal axis 134 and the inner surface 136 of the sidewall 110. The bead 138 has a longitudinal length 146 that is greater than a longitudinal length 148 of the planar surface 144, and the oblique surfaces 140, 142 may be similarly angled relative to the planar surface 144. Additionally, the bead 138 has a thickness 150 defined between an outer surface 152 of the sidewall 110 and the planar surface 144 that is the radially innermost surface of the bead 138. This thickness 150 defines the radially inward extension distance of the bead 138. The bead 138 is offset 154 from the first end 130 of the sidewall 110. Additionally, in the example a thickness 156 of the sidewall 110 at the first end 130 is greater than a thickness 158 of the sidewall 110 on the other side of the bead 138. The thickness 150 of the bead 138 is greater than the thicknesses 156, 158 of the sidewall 110.

It should be appreciated that while a trapezoidal cross-sectional shape of the bead 138 is described above and illustrated herein, the bead 138 can take on any other cross-sectional shape that enables the lid 100 to function as described herein. For example, but not limited to, circular, oval, square, etc.

The thickness 150 of the bead 138 is not constant around the sidewall 110. Rather, a portion of the bead 138 has a reduced extension distance and this portion of the bead 138 is disposed proximate the hinge 108. That is, the thickness 150 of the bead 138 proximate the hinge 108 tapers radially outward so as to gradually reduce thickness and reach a thinnest point 160 of the bead 138 underneath the hinge 108. This tapering of the thickness 150 of the bead 138 may be have a constant slope or otherwise as required or desired. A smallest extension distance of the reduced extension distance of the bead 138 occurs at the thinnest point 160. As such, the bead 138 has a first circumferential section 162 and a second circumferential section 164, with the first circumferential section 162 having the thickness 150 that is greater than a thickness 166 of the second circumferential section 164.

The second circumferential section 164 is positioned proximate the hinge 108 and with reference to the longitudinal axis 134 extends for an angular distance 168 between approximately 20°-135°. In an aspect, the angular distance 168 is about 90°. In the example, the thickness 166 of the second circumferential section 164 is not constant, rather, the thickness 166 reduces and tapers radially outward relative to the longitudinal axis 134 from the first circumferential section 162 to the thinnest point 160 underneath the hinge 108. The thinnest point 160 of the second circumferential section 164 may be located at the approximate midpoint of this section. As such, the second circumferential section 164 has a first end 170 and an opposite second end 172 with the thinnest point 160 therebetween, and the thinnest point 160 is located at the midpoint between the first end 170 and the second end 172.

From the first end 170 of the second circumferential section 164, the extension distance and the thickness 166 of the bead 138 radially tapers relative to the sidewall 110 in a counter-clockwise direction towards the thinnest point 160 and over half of the angular distance 168. As such, the first end 170 is radially thicker than the thinnest point 160. Similarly, from the second end 172 of the second circumferential section 164, the extension distance and the thickness 166 of the bead 138 radially tapers relative to the sidewall 110 in a clockwise direction towards the thinnest point 160 over the other half of the angular distance 168. As such, the second end 172 is radially thicker than the thinnest point 160. In the example, the tapering of the second circumferential section 164 is symmetrical relative to the hinge 108.

In another example, the strap 128 connecting the cap 106 to the hinge 108 has a width 180 that is the same or similar to the width of the hinge 108. The width 180 extends tangentially relative to the circumferential sidewall 110 and the diameter thereof. The second circumferential section 164 may correspond to the width 180 of the strap 128. For example, the first end 170 may be positioned proximate one side of the hinge 108 or strap 128 and the second end 172 may be positioned proximate the other side of the hinge 108 or strap 128. In an aspect, the sides of the hinge 108 or strap 128 can correspond to about a 30° angular distance 168 relative to the longitudinal axis 134.

Because the second circumferential section 164 of the bead 138 tapers in a radial direction, a planar surface 174 of the second circumferential section 164 and the radially innermost surface of the bead 138 has an increased longitudinal length 176 when compared to the longitudinal length 148 of the first circumferential section 162. The longitudinal length 176 of the planar surface 174 increases within the second circumferential section 164 in a direction towards the thinnest point 160 so that the longitudinal length 176 of the planar surface 174 is greatest at the thinnest point 160 and the smallest at the ends 170, 172. However, the overall longitudinal length 146 of the bead 138 at the second circumferential section 164 remains equal to the first circumferential section 162. As shown in FIG. 4, at the thinnest point 160, the planar surface 174 of the second circumferential section 164 may be reduced to such a thickness such that the surface 174 is co-planar with inner surface 136 of the sidewall 110 at the first end 130 of the sidewall 110 and the offset 154. Thereby, the thickness 156 of the sidewall 110 at the offset 154 and on one side of the bead 138 is approximately equal to the thickness 166 of the thinnest point 160. However, on the other side of the bead 138, the oblique surface 140 is still formed at the second circumferential section 164 such that a step 178 is formed between the bead 138 and the inner surface 136 of the sidewall 110 at the second end 132. Thus, the oblique surface 140 may engage with the container completely around the circumferential groove and induce at least some engagement force even at the reduced thickness area around the hinge 108.

In operation, by reducing the thickness of the bead 138 underneath the hinge 108, the tension forces transferred through the hinge 108 when the cap 106 is being pulled is reduced, thereby, reducing wear on the hinge 108. Additionally, the bead 138 still enables a secure connection with the container so that undesirable de-coupling is reduced or prevented.

The sidewall 110 of the base 104 defines an outer diameter 182. The well 116 is defined on the cover 112 and is co-axial with the sidewall 110 along the longitudinal axis 134. The well sidewall 122 defines an inner diameter 184 that is less than the diameter 182 of the sidewall 110. The well sidewall 122 extends along the longitudinal axis 134 and, in the example, the diameter proximate the bottom wall 118 is less than the diameter proximate the top wall 120. The bottom wall 118 of the well 116 can be approximately aligned with the second end 132 of the sidewall 110 so that the well 116 is positioned above the sidewall 110. In an aspect, the bottom wall 118 is orthogonal to the longitudinal axis 134 and is longitudinally offset from the bead 138. The major orifice 124 of the opening 114 is positioned around the longitudinal axis 134. Additionally, the cap 106 is substantially circular in shape and has an outer diameter 183. In the example, the diameter 183 of the cap 106 is less than the diameter 182 of the sidewall 110.

In the example, the base 104 and the cap 106 are substantially circular in shape. It should be appreciated that the base 104 and/or the cap 106 can take on other shapes as required or desired. For example, but not limited to, oval shapes or non-circular shapes.

Figure 5:
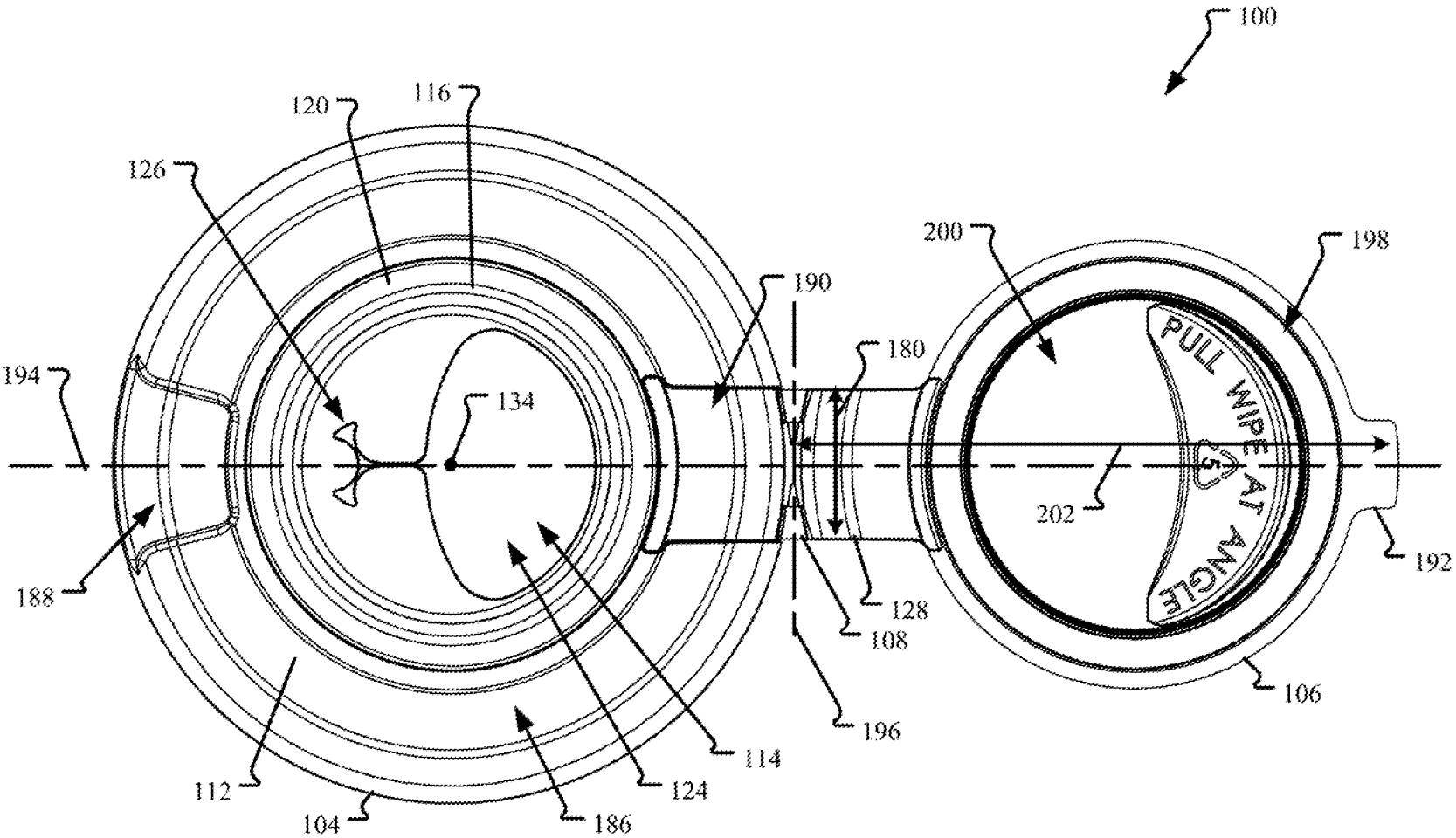
FIG. 5 is a top plan view of the lid shown in FIG. 1.

FIG. 5 is a top plan view of the lid 100. The cover 112 of the base 104 has an outer surface 186 with two recesses 188, 190 formed therein and spaced approximately 180° apart. The first recess 188 is disposed adjacent the minor orifice 126 and the second recess 190 is disposed adjacent the major orifice 124. In the example the recesses 188, 190 have different shapes and sizes. The second recess 190 is shaped and sized to at least partially receive the strap 128 when the lid 100 is in the closed configuration. This allows the cap 106 to more easily engage with top wall 120 of the well 116. Opposite of the strap 128, the cap 106 includes a tab 192. The tab 192 is provided to assist the user in opening and closing the cap 106. When the cap 106 is closed, the tab 192 extends over the first recess 188 so that there is a gap between the tab 192 and the outer surface 186 of the base 104. The recesses 188, 190, the hinge 108, the strap 128, the cap 106, and the tab 192 are aligned along a transverse axis 194 that is orthogonal to the longitudinal axis 134. The lid 100 is symmetrical about the transverse axis 194. To facilitate manufacturing and the molding of the lid 100, the hinge 108 at least partially extends from the cover 112 proximate the second end 132 of the sidewall 110 (shown in FIG. 4) so that there are no features of the lid 100 that are above one another in the illustrated open configuration.

In operation, the lid 100 is movable between the illustrated open configuration and a closed configuration (not shown). More specifically, the hinge 108 defines a rotation axis 196 that the strap 128, the cap 106, and the tab 192 rotate around so as to move the lid 100 towards the closed configuration. The rotation axis 196 is orthogonal to both the longitudinal axis 134 and the transverse axis 194. In the closed configuration, a circumferential channel 198 defined on an inner surface 200 of the cap 106 engages with the top wall 120 of the well 116 so as to close the opening 114. As used herein, the closed configuration may include both positioning the cap 106 directly over and aligned with the well 116, but not necessarily engaged therewith, or at least partially engaging the cap 106 with the well 116. In former configuration, the user may need to further press the cap 106 onto the well 116 to seal the cap 106 on the base 104, however, the closed configuration facilitates the alignment of the cap 106 to the well 116 so that the complete closure of the cap 106 is easier for the user. In the later configuration, the hinge 108 enables the cap 106 to at least partially engage with the well 116 on its own and not necessarily with further action by the user.

In the example, the hinge 108 is a bi-stable hinge such that the position of the cap 106 can be maintained in either the open configuration (as illustrated) or the closed configuration. As such, the hinge 108 defines a transition angle whereby once a user pushes the cap 106 past the transition angle, the cap 106 is biased and automatically moves towards and stays positioned relative to the base 104 of the lid 100. In an aspect, the closed and open configurations of the cap 106 are approximately 180° apart, and as such, the transition angle is about half and about a 90° angle, for example, when the cap 106 is oriented parallel to the longitudinal axis 134. The hinge 108 is described further below in reference to FIGS. 6-8.

To enable the bi-stable positioning of the hinge 108, the hinge 108 generates a spring force during the opening and closing movements. This spring force is large enough to stabilize the cap 106, the strap 128, and the tab 192 in either the open or closed configuration and is at least partially defined by the width 180 of the hinge 108/strap 128 and a lever arm distance 202 of the cap 106 along the transverse axis 194. The width 180 is parallel to the rotation axis 196 and the lever arm distance 202 is parallel to the transverse axis 194 and is between the rotation axis 196 and the distal end of the tab 192. The longer the lever arm distance 202, the greater amount of spring force is needed in the hinge 108 so as to provide the bi-stable functionality as described herein, while the wider the width 180 of the hinge 108 the greater amount of spring force is generated. However, material yield properties of the lid 100 limit how wide the hinge 108 may be formed. As such, in an aspect, a ratio of width 180 of the hinge 108 to lever arm distance 202 of the strap 128 and cap 106 is between about 1:2 and 1:6. In another aspect, the ratio is between about 1:3 and 1:5. In yet another aspect, the ratio is about 1:4.

In another example, the spring force of the hinge 108 may be at least partially defined by the width 180 of the hinge 108/strap 128 and the size of the base 104 and/or the cap 106. For example, a ratio of width 180 of the hinge 108 to the outer diameter 182 (shown in FIG. 4) of the base 104 along the transverse axis 194 is between about 1:4 and 1:5. In an aspect, the ratio is about 1:4.5. In another example, a ratio of width 180 of the hinge 108 to the outer diameter 183 (shown in FIG. 4) of the cap 106 along the transverse axis 194 is between about 1:1 and 1:3.5. In an aspect, the ratio is about 1:3.

Figure 7:
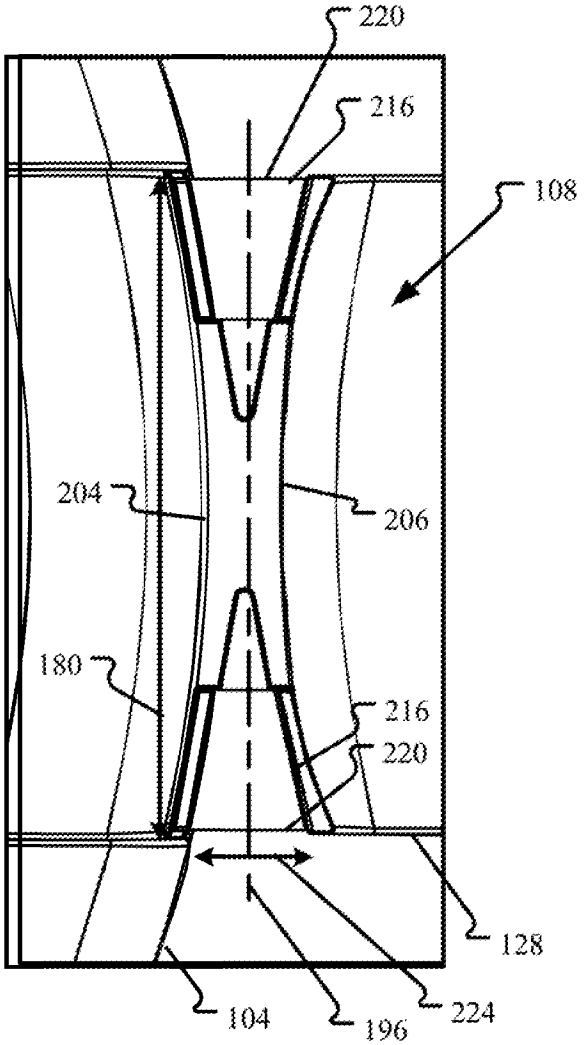
FIG. 7 is an enlarged top plan view of the hinge shown in FIG. 6.
Figure 6:
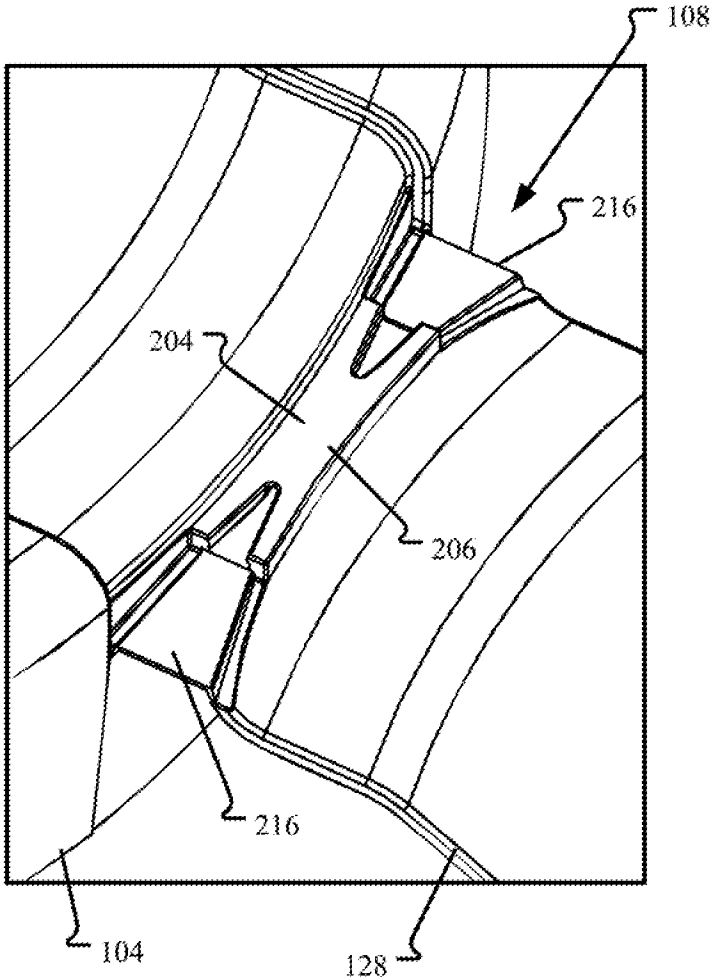
FIG. 6 is an enlarged perspective view of an exemplary hinge of the lid shown in FIGS. 1-5.
Figure 8:
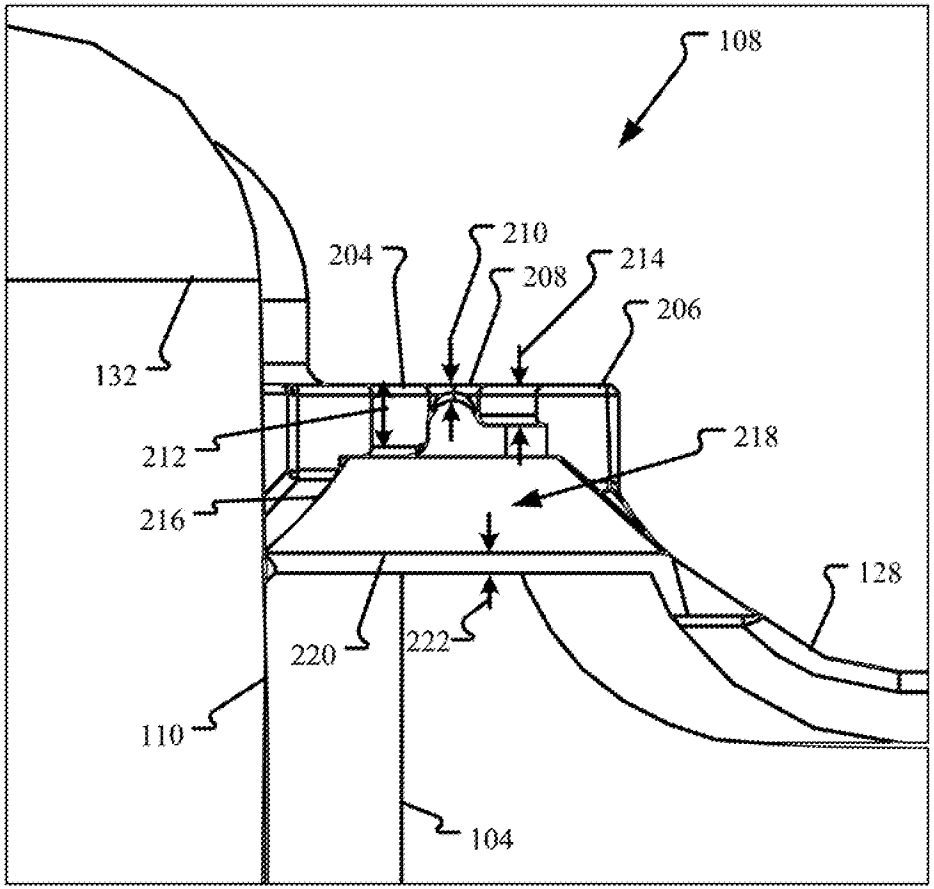
FIG. 8 is a side elevation view of the hinge shown in FIG. 6.

FIG. 6 is an enlarged perspective view of the hinge 108. FIG. 7 is an enlarged top plan view of the hinge 108. FIG. 8 is a side elevation view of the hinge 108. Referring concurrently to FIGS. 6-8, the hinge 108 is a bi-stable hinge as described above and extends between the base 104 and the strap 128. The width 180 of the strap 128 and the hinge 108 are approximately equal. The hinge 108 includes a first arm 204 extending from the sidewall 110 of the base 104 proximate the second end 132 and a second arm 206 extending from the strap 128. The first arm 204 and the second arm 206 are coupled together at a flexible joint 208 that defines the rotation axis 196 of the hinge 108 and the cap 106 (shown in FIG. 1). The flexible joint 208 has a reduced thickness 210 compared to a thickness 212 of the first arm 204 and a thickness 214 of the second arm 206 as illustrated in FIG. 8. In the example, the thickness 212 of the first arm 204 is greater than the thickness 214 of the second arm 206. The top outer perimeter shape of the first arm 204 and the second arm 206 are similar as shown in FIG. 7 and form an X-like shape.

The hinge 108 also includes a pair of energy bands 216 that extend between the sidewall 110 and the strap 128 and flank the first arm 204 and the second arm 206. The energy band 216 has a trapezoidal shape top surface 218 that slopes downward towards an outside edge 220. The outside edges 220 of the energy bands 216 define the width 180 of the hinge 108. The energy band 216 also has a thickness 222. The thickness of the hinge 108 (e.g., the thickness 210 of the joint 208 and the thickness 222 of the energy band 216) are thinner than the rest of the lid and are also moveable components, thus creating a high wear area on the lid. For example, a user pulling on the cap 106 can exceed the tensile strength of the material of the hinge 108 and wear initiating at the energy bands 216 (e.g., a high tension component) can propagate to other components of the hinge 108. By reducing the bead 138 (shown in FIG. 4) that is used to attach the lid to the container at the location below the hinge 108, tension forces transferred through the hinge 108 are reduced, thereby increasing performance of the lid for the user.

Additionally or alternatively, by reducing tension forces in the hinge 108, the components of the hinge 108 can be made thinner, thereby increasing hinge 108 performance and operational capabilities. In the example, the hinge 108 is a bi-stable hinge that stabilizes the cap 106 and the strap 128 in either the open or closed configuration. The energy bands 216 generate the spring force within the hinge 108 so that when the user pushes the cap 106 past a transition angle (e.g., 90°), the cap 106 automatically moves towards and stays positioned relative to the base 104 and in either the open configuration or the closed configuration. In the example, the spring force generated by the energy bands 216 is induced by the energy bands 216 partially deforming the sidewall 110 of the base 104. In operation, this partial deformation of the sidewall 110 creates a tactile feed back for the user when moving past the transition angle and indicate to the user when the lid is biased opened or closed. The spring force generated by the energy bands 216 is less than the yield strength of the lid material and as such, the sidewall 110 returns to its original undeformed state in either the open configuration or the closed configuration.

In the example, the flexible joint 208 and the rotation axis 196 are tangential to the sidewall 110 and the size of the energy bands 216 at least partially define the amount of spring force that can be generated. As such, the further apart the outside edges 220 are spaced, the greater amount of spring force the energy bands 216 generate. The amount of spring force required or desired for the cap 106 is at least the amount to facilitate its bi-stable movement of the cap 106 and can be based on the size of the energy bands 216. The larger the size (e.g., the wider the hinge 109), the more spring force generated. However, the size of the energy bands 216 should not generate a spring force that exceeds the yield strength of the lid material. As such, in an aspect, a ratio of transverse length 224 of the outside edge 220 of the energy band 216 to the diameter 182 of the sidewall 110 (shown in FIG. 4) is between about 1:15 and 1:35. In another aspect, the ratio is between about 1:20 and 1:30. In yet another aspect, the ratio is about 1:25.

In operation, the spring force generated by the hinge 108 may move the cap 106 towards its closed configuration on the base 104, but may not engage the channel 198 of the cap 106 with the top wall 120 of the well 116 (shown in FIG. 5). However, the spring force of the hinge 108 may be sufficient to position the cap 106 directly over and aligned with the well 116 so that wet sheet material can be reduced or prevented from drying out. In this example, the user may need to apply force to the cap 106 to at least partially engage the cap 106 to the well 116. The hinge 108 in the closed configuration automatically aligns the cap 106 over the well 116 so as to facilitate a more easy and quick closure action for the user with one press. In other examples, the spring force of the hinge 108 may at least partially engage the cap 106 with the well 116.

While an energy band bi-stable type hinge is illustrated and described herein, it should be appreciated that any other hinge configuration that enables operation of the lid as described herein can be utilized as required or desired. For example, a flange-type hinge can be used with the energy bands and central hinge connection being in a continuous web having a bowtie outer perimeter shape.

Figure 9:
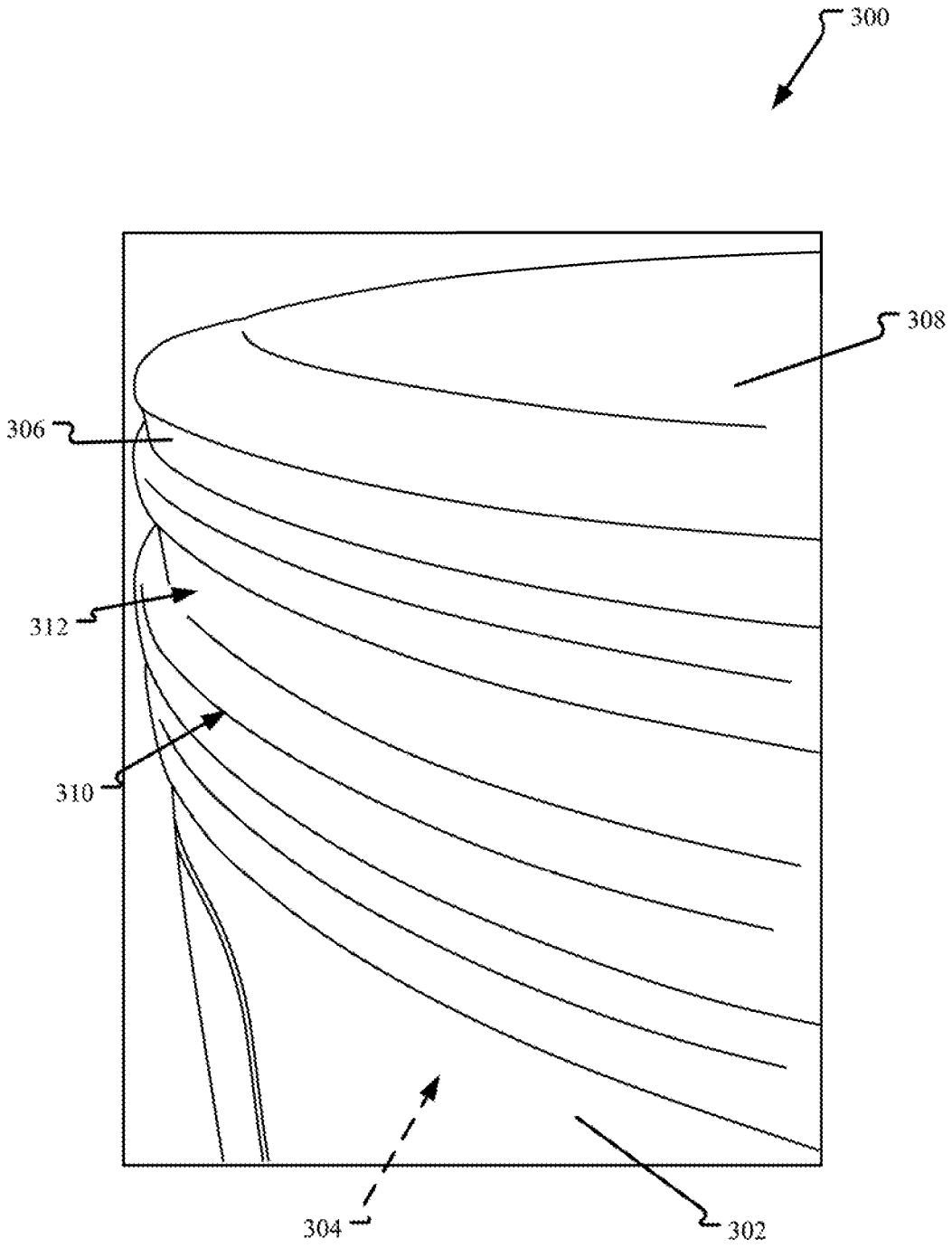
FIG. 9 is a partial perspective view of an exemplary container.

FIG. 9 is a partial perspective view of an exemplary container 300. The container 300 is configured so that the lid 100 described above in FIGS. 1-8 can be removably coupled thereto and form a dispenser for sheet material (not shown) contained within the container 300. The dispenser apparatus includes both the lid 100 and the container 300. The container 300 has a cylindrical cross-sectional shaped body 302 that defines an interior chamber 304 for holding the sheet material. The lid 100 closes the interior chamber 304. The body 302 has an open end 306 that is configured to receive the base of the lid 100. At the open end 306 a film seal 308 can be used when the sheet material is wet, and to dispense the wet sheet material, the film seal 308 needs to be removed and the lid 100 taken off of the container 300 as described herein.

The body 302 of the container 300 has an outer surface 310 with a recessed circumferential groove 312 defined therein. The groove 312 is shaped and sized to receive the bead 138 of the lid 100 (shown in FIG. 4) so as to releasably secure the lid 100 to the open end 306 of the container 300. Unlike the bead 138, the circumferential groove 312 has a constant depth around the perimeter of the outer surface 310 so that the orientation of the lid 100 relative to the container 300 will not affect securing the lid 100 to the container 300. In an aspect, the cross-sectional shape of the groove 312 may correspond to the shape of the bead 138 without the tapering as described above and trapezoidal in shape.

As described above, the bead coupling connection between the base of the lid and the container is reduced in the area proximate the hinge. As such, the tension forces induced in the hinge are reduced when the user is pulling on the cap. This configuration reduces wear on the hinge, thereby increasing performance of the lid. Additionally, the bead enables the base to remain sufficiently coupled to the container so that the lid is reduced or prevented from un-desirably decoupling. Furthermore, by reducing the tension forces acting on the hinge, the thickness of components the hinge can be reduced, which increases the ability for the hinge to flex and have bi-stable functionality to increase the opening and closing functions of the cap. For example, increased flexibility of the hinge enables automatic alignment of the cap relative to the opening for quick closure with one press. Additionally, the hinge has two-position functionality, with the flexibility of the hinge enabling the cap to be moved towards the open configuration when opened and moved towards the closed configuration when closed. In the closed configuration, the user may need to press on the cap to seal the cap to the well. This movement ensures that the cap is fully out of the way during usage and closes with a single user motion. The configuration of the well also positions the sheet material away from the top wall so that closing performance of the cap is increased when the cap is moving towards the closed configuration.

It should be appreciated that while the bead and hinge features are described as working in conjunction with one another to increase the performance and functionality of the lid, each feature (e.g., the bead or the hinge) individually and separably increases the performance and functionality of the lid as described herein. Thus, the bead or the hinge can be utilized independently from one another to increase the performance and functionality of the lid. For example, the bead reducing in thickness in the area proximate the hinge reduces wear on the hinge no matter what type hinge is used on the lid. In another example, the hinge generating spring strength for the two-position bi-stable functionality increases performance of the lid no matter what type of connection is being used between the container and the lid. Moreover, many variations in the appearance of the lid described herein are possible, which can still achieve the functions and advantages of the lid. However, the particular lid shown in drawings has been selected because it is eye catching and attractive, in addition to be distinctive.

EXAMPLES

Illustrated examples of the lid and container described herein are provided below. An example of the lid and/or lid and container may include any one or more, and any combination of, the examples described below.

Example 1 is a lid for a container. The lid having a base with a sidewall having a first end and an opposite second end defining a longitudinal axis, a cover disposed at the second end and defining an opening, and a bead extending inwardly from the sidewall relative to the longitudinal axis and proximate the first end. The bead has an extension distance, and a portion of the bead has a reduced extension distance. The lid also having a cap configured to couple to the base and selectively engage the cover proximate the opening.

In Example 2, the subject matter of Example 1 further includes a hinge coupling the cap to the base. The portion of the bead that has the reduced extension distance is proximate the hinge.

In Example 3, the subject matter of any one of the preceding Examples is further configured such that the portion of the bead that has the reduced extension distance has a first end, an opposite second end, and a midpoint therebetween. The extension distance of the bead tapers continuously inward relative to the sidewall from the first end and the second end of the portion of the bead that has the reduced extension distance towards the midpoint.

In Example 4, the subject matter of Example 3 is further configured such that a smallest extension distance of the reduced extension distance of the bead occurs at the midpoint.

In Example 5, the subject matter of Example 3 is further includes a strap disposed between the cap and the base. The strap defining a width. The first end of the portion of the bead that has the reduced extension distance is disposed proximate one side of the strap and the second end of the portion of the bead that has the reduced extension distance is disposed proximate the other side of the strap such that the portion of the bead that has the reduced extension distance extends at least across the width of the strap.

In Example 6, the subject matter of any one of the preceding Examples is further configured such that the bead has a trapezoidal cross-sectional shape and a thickness of the bead from a radially innermost surface towards the sidewall defines the extension distance.

In Example 7, the subject matter of Example 6 is further configured such that the radially innermost surface has a first longitudinal length at the extension distance and a second longitudinal length at the portion of the bead that has the reduced extension distance, the second longitudinal length greater than the first longitudinal length.

In Example 8, the subject matter of any one of the preceding Examples is further configured such that the bead is offset from the first end. A thickness of the sidewall at the first end and on one side of the bead is greater than a thickness of the sidewall on an opposite side of the bead proximate the second end.

In Example 9, the subject matter of Example 8 is further configured such that a portion of the portion of the bead that has the reduced thickness is planar with an inner surface of the first end of the sidewall.

Example 10 is a lid for a container. The lid including a base with a cylindrical sidewall having a first end and an opposite second end defining a longitudinal axis, the cylindrical sidewall also having an inner surface, a cover disposed at the second end and defining an opening, and a bead extending radially from the inner surface of the cylindrical sidewall and configured to engage with the container. The bead including a first circumferential section and a second circumferential section. The first circumferential section having a radial thickness greater than a radial thickness of the second circumferential section. The lid also including a cap connected to the base via a hinge and configured to selectively engage the cover proximate the opening. The second circumferential section of the radial bead is disposed proximate the hinge.

In Example 11, the subject matter of Example 10 is further configured such that the second circumferential section has an angular distance of about 90°.

In Example 12, the subject matter of any one of Examples 10-11 is further configured such that the hinge defines a midpoint of the second circumferential section. The radial thickness of the second circumferential section tapers inwardly towards the inner surface of the sidewall such that a smallest radial thickness of the second circumferential section is at the midpoint.

In Example 13, the subject matter of any one of Examples 10-12 is further configured such that the bead has a trapezoidal cross-section with a planar surface. A planar surface of the first circumferential section of the bead has a longitudinal length that is less than a longitudinal length of a planar surface of the second circumferential section of the bead.

In Example 14, the subject matter of any one of Examples 10-13 is further includes a strap extending between the cap and the hinge. A width of the strap is approximately equal to a width of the hinge.

In Example, 15, the subject matter of Example 14 is further configured such that the hinge includes a first arm extending from the base and a second arm extending from the strap coupled together at a flexible joint, and a pair of energy bands extending between the base and the strap flanking the first arm and the second arm. The pair of energy bands define the width of the hinge.

Example 16 is a dispenser for sheet material with a container defining an interior chamber, and a lid removably secured to the container for closing the interior chamber. The lid includes a base having a cover defining an opening, a sidewall extending from one side of the cover, the sidewall having an outer surface, and a bead disposed on the sidewall and configured to engage with the container. The bead has a thickness defined from the outer surface of the sidewall. The lid further includes a cap configured to selectively engage the cover proximate the opening, a strap extending from the cap, and a hinge connecting the strap and the base. The thickness of the bead proximate the hinge tapers so as to gradually reduce thickness and reach a thinnest point underneath the hinge.

In Example 17, the subject matter of Example 16 is further configured such that the sidewall is cylindrical and the tapering of the bead occurs within ±45° relative to the hinge.

In Example 18, the subject matter of Example 17 is further configured such that the tapering of the bead is symmetrical relative to the hinge.

In Example 19, the subject matter of any one of Examples 16-18 is further configured such that the thinnest point of the bead is planar with an inner surface of the sidewall on one side of the bead and a step is formed at the inner surface of the sidewall on the other side of the bead.

In Example 20, the subject matter of any one of Examples 16-19 is further configured such that the container includes an open end having a circumferential groove defined in an outer surface configured to engage with the bead of the lid.

In Example 21, the subject matter of Example 20 is further configured such that the circumferential groove has a constant depth around a perimeter of the outer surface.

Example 22 is a lid for a container. The lid including a base having a sidewall having a first end and an opposite second end defining a longitudinal axis, and a cover disposed at the second end and defining an opening. The lid also including a cap coupled to the base and configured to selectively engage the cover proximate the opening, the cap having a strap extending therefrom, and a hinge connecting the strap to the base and defining a rotation axis orthogonal to the longitudinal axis. The hinge has a width defined along the rotation axis and a lever arm distance is defined between the rotation axis and a distal end of the cap along a transverse axis orthogonal to both the longitudinal axis and the rotation axis. A ratio of the width to the lever arm distance is between about 1:3 and 1:5.

In Example 23, the subject matter of Example 22 is further configured such that the ratio of the width to the lever arm distance is about 1:4.

In Example 24, the subject matter of any one of Examples 22-23 is further configured such that the sidewall has an outer surface and a bead is disposed on the sidewall configured to engage with the container. The bead has a thickness defined from the outer surface of the sidewall and the thickness of the bead proximate the hinge tapers so as to gradually reduce thickness and reach a thinnest point underneath the hinge.

Example 25 is a lid for a container. The lid including a base having a cylindrical sidewall having a first end and an opposite second end defining a longitudinal axis, the cylindrical sidewall defining a diameter, and a cover disposed at the second end and defining an opening. The lid also including a cap coupled to the base and configured to selectively engage the cover proximate the opening, the cap having a strap extending therefrom, and a hinge connecting the strap to the base and defining a rotation axis orthogonal to the longitudinal axis. The hinge has an outside edge length defined along a transverse axis orthogonal to both the longitudinal axis and the rotation axis. A ratio of the diameter of the cylindrical sidewall to the outside edge length is between about 1:20 and 1:30.

In Example 26, the subject matter of Example 25 is further configured such that the ratio of the cylindrical sidewall to the outside edge length is about 1:25.

In Example 27, the subject matter of any one of Examples 25-26 is further configured such that the cylindrical sidewall has an inner surface and a bead extending radially from the inner surface of the cylindrical sidewall configured to engage with the container. The bead includes a first circumferential section and a second circumferential section, the first circumferential section having a radial thickness greater than a radial thickness of the second circumferential section. The second circumferential section of the radial bead is disposed proximate the hinge.

Example 28 is a lid for a container. The lid including a base with a sidewall having a first end and an opposite second end defining a longitudinal axis, and a cover disposed at the second end and defining an opening. The lid also including a cap coupled to the base and configured to selectively engage the cover proximate the opening, the cap having a strap extending therefrom and defining an outer diameter, and a hinge connecting the strap to the base and defining a rotation axis orthogonal to the longitudinal axis. The hinge has a width defined along the rotation axis and the outer diameter of the cap is along a transverse axis orthogonal to both the longitudinal axis and the rotation axis. A ratio of the width to outer diameter is between about 1:1 and 1:3.5.

In Example 29, the subject matter of Example 28 is further configured such that the ratio of the width to the outer diameter is about 1:3.

In Example 30, the subject matter of any one of Examples 28-29 is further configured such that the sidewall has an outer surface and a bead is disposed on the sidewall configured to engage with the container. The bead has a thickness defined from the outer surface of the sidewall and the thickness of the bead proximate the hinge tapers so as to gradually reduce thickness and reach a thinnest point underneath the hinge.

This disclosure describes some examples of the present technology with reference to the accompanying drawings, in which only some of the possible examples were shown. Other aspects can, however, be embodied in many different forms and should not be construed as limited to the examples set forth herein. Rather, these examples were provided so that this disclosure was thorough and complete and fully conveyed the scope of the possible examples to those skilled in the art. Any number of the features of the different examples described herein may be combined into one single example and alternate examples having fewer than or more than all of the features herein described are possible. Further, as used herein and in the claims, the phrase "at least one of element A, element B, or element C" is intended to convey any of: element A, element B, element C, elements A and B, elements A and C, elements B and C, and elements A, B, and C. It is to be understood that terminology employed herein is used for the purpose of describing particular examples only and is not intended to be limiting. It must be noted that, as used in this specification, the singular forms "a," "an," and "the" include plural referents unless the context clearly dictates otherwise. Further, one having skill in the art will understand the degree to which terms such as "about" or "substantially" convey in light of the measurement techniques utilized herein. To the extend such terms may not be clearly defined or understood by one having skill in the art, the terms such as "about" or "substantially" shall mean plus or minus ten percent.

Although specific examples were described herein, the scope of the technology is not limited to those specific examples. One skilled in the art will recognize other examples or improvements that are within the scope of the present technology. Therefore, the specific structure, acts, or media are disclosed only as illustrative examples. Examples according to the technology may also combine elements or components of those that are disclosed in general but not expressly exemplified in combination, unless otherwise stated herein. The scope of the technology is defined by the following claims and any equivalents therein.

What is claimed is:

1. A lid for a container, the lid comprising:

a base comprising:

a sidewall having an inner surface, a first end, and a second end;

a cover disposed at the second end of the sidewall and defining an opening;

a bead disposed on the inner surface of the sidewall proximate the first end of the sidewall and extending inwardly from the inner surface of the sidewall, the bead having a first circumferential section and a second circumferential section, with the first and second circumferential sections being opposite from each other on opposite sides of the sidewall, and with the first circumferential section having a thickness greater than the thickness of the second circumferential section; and a well disposed in the base above the sidewall and above the bead; and a cap configured to couple to the base with a hinge and selectively engage the cover proximate the well.

2. The lid of claim 1, further comprising a hinge and a strap coupling the cap to the base, wherein the strap nests into the cover when the cap is closed onto the base.

3. The lid of claim 1, wherein the thickness of the bead has a reduced extension distance proximate the well, and wherein the portion of the bead that has the reduced extension distance has a first end, an opposite second end, and a midpoint therebetween, and wherein the extension distance of the bead tapers continuously inward relative to the sidewall from the first end and the second end of the portion of the bead that has the reduced extension distance towards the midpoint.

4. The lid of claim 3, wherein a smallest extension distance of the reduced extension distance of the bead occurs at the midpoint.

5. The lid of claim 3, further comprising a strap disposed between the cap and the base, the strap defining a width, and wherein the first end of the portion of the bead that has the reduced extension distance is disposed proximate one side of the strap and the second end of the portion of the bead that has the reduced extension distance is disposed proximate the other side of the strap such that the portion of the bead that has the reduced extension distance extends at least across the width of the strap.

6. The lid of claim 3, wherein the bead has a trapezoidal cross-sectional shape and a thickness of the bead from a radially innermost surface towards the sidewall defines the extension distance.

7. The lid of claim 6, wherein the radially innermost surface has a first longitudinal length at the extension distance and a second longitudinal length at the portion of the bead that has the reduced extension distance, the second longitudinal length greater than the first longitudinal length.

8. The lid of claim 1, wherein the bead is offset from the first end, wherein a thickness of the sidewall at the first end and on one side of the bead is greater than a thickness of the sidewall on an opposite side of the bead proximate the second end.

9. The lid of claim 8, wherein a portion of the portion of the bead that has the reduced thickness is planar with an inner surface of the first end of the sidewall.

10. A lid for a container, the lid comprising:

a base comprising:

a cylindrical sidewall having an inner surface, a first end, and a second end;

a cover disposed at the second end of the cylindrical sidewall and defining an opening;

a bead disposed on and extending radially inward from the inner surface of the cylindrical sidewall proximate the first end of the cylindrical sidewall and configured to engage with the container, the bead comprising a first circumferential section and a second circumferential section, with the first and second circumferential sections being opposite from each other on opposite sides of the sidewall, and with the first circumferential section having a radial thickness greater than a radial thickness of the second circumferential section; and a well disposed in the base above the sidewall and above the bead; and a cap connected to the base via a hinge and a strap and configured to selectively engage the cover proximate the opening, wherein the second circumferential section of the bead is disposed proximate the hinge.

11. The lid of claim 10, wherein the second circumferential section has an angular distance of about 90°.

12. The lid of claim 10, wherein the hinge defines a midpoint of the second circumferential section, and the radial thickness of the second circumferential section tapers inwardly towards the inner surface of the sidewall such that a smallest radial thickness of the second circumferential section is at the midpoint.

13. The lid of claim 10, wherein the bead has a trapezoidal cross-section with a planar surface, and wherein a planar surface of the first circumferential section of the bead has a longitudinal length that is less than a longitudinal length of a planar surface of the second circumferential section of the bead.

14. The lid of claim 10, further comprising a strap extending between the cap and the hinge, wherein a width of the strap is approximately equal to a width of the hinge.

15. The lid of claim 14, wherein the hinge comprises:

a first arm extending from the base and a second arm extending from the strap coupled together at a flexible joint; and a pair of energy bands extending between the base and the strap flanking the first arm and the second arm, wherein the pair of energy bands define the width of the hinge.

16. A dispenser for sheet material comprising:

a container defining an interior chamber; and a lid removably secured to the container for closing the interior chamber, the lid comprising:

a base comprising:

a cover defining an opening;

a sidewall extending from one side of the cover, the sidewall having an inner surface;

a bead disposed on the inner surface of the sidewall and configured to engage with the container, wherein the bead has a variable thickness defined from the inner surface of the sidewall, with a first circumferential section of the bead having a thickness greater than the thickness of a second circumferential section of the bead, and with the first and second circumferential sections being opposite from each other on opposite sides of the sidewall; and a well disposed in the base above the sidewall and above the bead;

a cap configured to selectively engage the cover proximate the opening;

a strap extending from the cap; and a hinge connecting the strap and the base, wherein the thickness of the bead proximate the hinge tapers so as to gradually reduce thickness and reach a thinnest point underneath the hinge.

17. The dispenser of claim 16, wherein the sidewall is cylindrical and the tapering of the bead occurs within ±45° relative to the hinge.

18. The dispenser of claim 17, wherein the tapering of the bead is symmetrical relative to the hinge.

19. The dispenser of claim 16, wherein the thinnest point of the bead is planar with an inner surface of the sidewall on one side of the bead and a step is formed at the inner surface of the sidewall on the other side of the bead.

20. The dispenser of claim 16, wherein the container comprises an open end having a circumferential groove defined in an outer surface configured to engage with the bead of the lid.

21. A lid for a container, the lid comprising:

a base comprising:

a sidewall having an inner surface, a first end, and a second end;

a cover disposed at the second end of the sidewall and defining an opening;

a bead disposed on the inner surface of the sidewall proximate the first end of the sidewall and extending inwardly from the inner surface of the sidewall, the bead having a first circumferential section and a second circumferential section, with the first and second circumferential sections being opposite from each other on opposite sides of the sidewall, and with the first circumferential section having a thickness greater than the thickness of the second circumferential section; and a well disposed in the base above the sidewall and above the bead; and a cap connected to the base via a hinge and a strap and configured to selectively engage the cover proximate the well, wherein the second circumferential section of the bead is disposed proximate the hinge, and wherein the strap nests into the cover when the cap is closed onto the cover.

22. The hinge and strap of claim 21, wherein the strap nests into the cover when the cap is closed onto the base.

23. The lid of claim 21, wherein the thickness of the bead has a reduced extension distance proximate the well, and wherein the portion of the bead that has the reduced extension distance has a first end, an opposite second end, and a midpoint therebetween, and wherein the extension distance of the bead tapers continuously inward relative to the sidewall from the first end and the second end of the portion of the bead that has the reduced extension distance towards the midpoint.

24. The lid of claim 23, wherein a smallest extension distance of the reduced extension distance of the bead occurs at the midpoint.

25. The lid of claim 23, further comprising a strap disposed between the cap and the base, the strap defining a width, and wherein the first end of the portion of the bead that has the reduced extension distance is disposed proximate one side of the strap and the second end of the portion of the bead that has the reduced extension distance is disposed proximate the other side of the strap such that the portion of the bead that has the reduced extension distance extends at least across the width of the strap.

26. The lid of claim 23, wherein the bead has a trapezoidal cross-sectional shape and a thickness of the bead from a radially innermost surface towards the sidewall defines the extension distance.

27. The lid of claim 26, wherein the radially innermost surface has a first longitudinal length at the extension distance and a second longitudinal length at the portion of the bead that has the reduced extension distance, the second longitudinal length greater than the first longitudinal length.

28. The lid of claim 21, wherein the bead is offset from the first end, wherein a thickness of the sidewall at the first end and on one side of the bead is greater than a thickness of the sidewall on an opposite side of the bead proximate the second end.

29. The lid of claim 28, wherein a portion of the portion of the bead that has the reduced thickness is planar with an inner surface of the first end of the sidewall.

* * * * *